United States Patent [19]
Germain et al.
[11] 4,298,188
[45] Nov. 3, 1981

[54] MACHINES FOR COOLING METAL SHEETS OR LIKE PRODUCTS

[75] Inventors: Alfred Germain; Georges Bonamour du Tartre, both of Dunkerque, France

[73] Assignee: Union Siderurgique du nord et de l'est de la France ("USINOR"), France

[21] Appl. No.: 156,344

[22] Filed: Jun. 4, 1980

[30] Foreign Application Priority Data

Jun. 13, 1979 [FR] France ..... 79 15107

[51] Int. Cl.[3] ..... B08B 3/04; F25D 13/06

[52] U.S. Cl. ..... 266/114; 266/117; 148/156; 134/9; 134/122 R

[58] Field of Search ..... 266/114, 115, 117, 133, 266/259, 269; 134/9, 83, 108, 122 R, 134; 148/156

[56] References Cited

U.S. PATENT DOCUMENTS

| | | | |
|---|---|---|---|
| 3,792,844 | 2/1974 | Berry et al. | 266/117 |
| 3,885,581 | 5/1975 | Dahan et al. | 266/114 X |
| 3,990,257 | 11/1976 | Taylor et al. | 266/114 X |
| 4,185,649 | 1/1980 | Germain | 134/122 R |

*Primary Examiner*—G. O. Peters
*Attorney, Agent, or Firm*—Cushman, Darby & Cushman

[57] ABSTRACT

The machine for cooling metal sheets has a lower frame and an upper frame, sets of sheet driving and guiding rolls rotatively mounted in the frames. These frames define an enclosure which surrounds the rolls and in which enclosure a cooling fluid circulates. A system of fluid discharge conduits is connected to the upper frames and a system of fluid discharge conduits is connected to the lower frame. These discharge conduits are disposed in the vicinity of input and output ends of the machine. A cooling fluid recovery tank is provided. At least the discharge conduits connected to the upper frame and located in the vicinity of the input and output ends of the machine are connected to the cooling fluid recovery tank with interposition of a siphon. A priming device is combined with the siphon for creating a depression in the siphon. There may also be associated with the cooling fluid discharge system of the lower frame, for instance on at least one discharge conduit connected to the lower frame, apparatus such as a valve, adapted to regulate the flow in the respective conduit, for regulating the pressure drop in the machine.

3 Claims, 3 Drawing Figures

3
2
23
22
4
3
1
18
19
5
2
21
20
R
24
h
12
10
25
26
13
11
27
2

MACHINES FOR COOLING METAL SHEETS OR LIKE PRODUCTS

The present invention relates to machines for cooling or quenching metal sheets or like products, in particular a machine such as that disclosed in French Pat. No. 73 10 710 filed on March 26, 1973 by the Applicant.

Such a machine comprises a lower frame and an upper frame in which there are mounted sets of driving and guiding rolls which operate in pairs, said frame defining an enclosure in which a cooling fluid circulates. In one embodiment, this enclosure surrounds also the driving an guiding rolls and the inlets and outlets of the cooling fluid are located in the region of these rolls. Preferably, the cooling liquid is supplied and discharged in the region of different sets of rolls, the discharge being achieved in particular in the region of sets of rolls located respectively in the vicinity of the input and output ends of the machine. Indeed, it is desirable to arrange that the discharge be as close as possible to the ends so as to avoid considerable escape of cooling liquid when the sheet enters and leaves the machine and also in the course of operation.

However, it has been found that, notwithstanding this precaution, leakages occur and the object of the invention is to provide this machine with an improvement which decreases the magnitude of such leakages in the region of the input and output ends of the machine.

According to the invention, there is provided a machine for cooling sheets comprising a lower frame and an upper frame in which there are mounted sets of driving and guiding rolls for the sheet, and which define an enclosure which surrounds said rolls and in which enclosure circulates a cooling fluid, said fluid being discharged in particular through conduits which are disposed in the vicinity of the input and output ends of the machine, wherein at least the discharge conduits connected to the upper frame and located in the vicinity of the input and output ends of the machine are connected to a tank for recovering the cooling liquid by way of a siphon on which there is placed a priming device adapted to create a depression in said siphon.

According to another feature, there is provided on at least one discharge conduit connected to the lower frame a valve which is adapted to regulate the flow in said conduit.

The invention will be described in more detail hereinafter with reference to the accompanying drawing which is given solely by way of example and in which.

Figure 1:
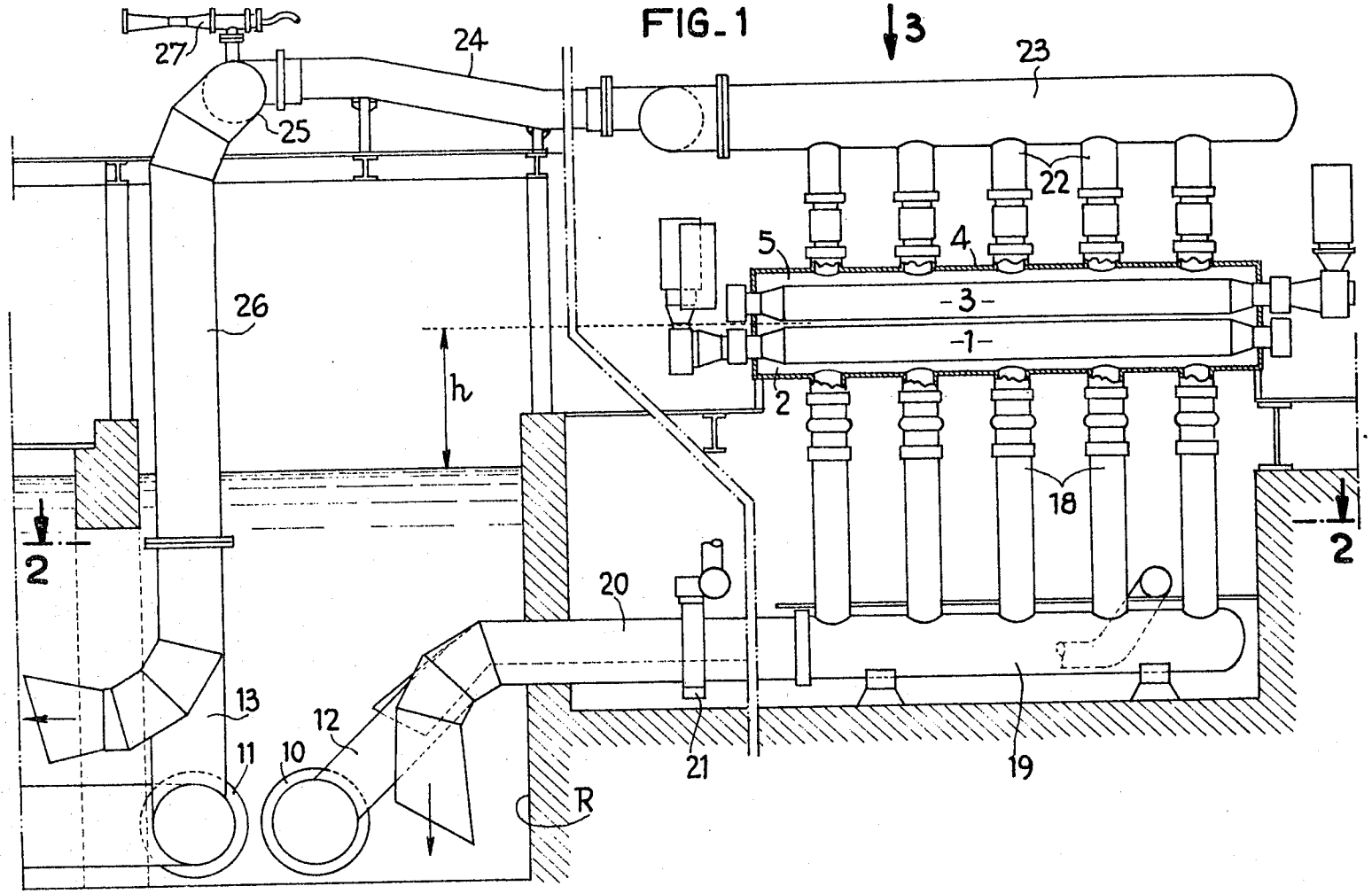
FIG. 1 is a diagrammatic cross-sectional view taken on line 1—1 of FIG. 2 of an improved machine according to the invention, some parts of which are broken away.
Figure 2:
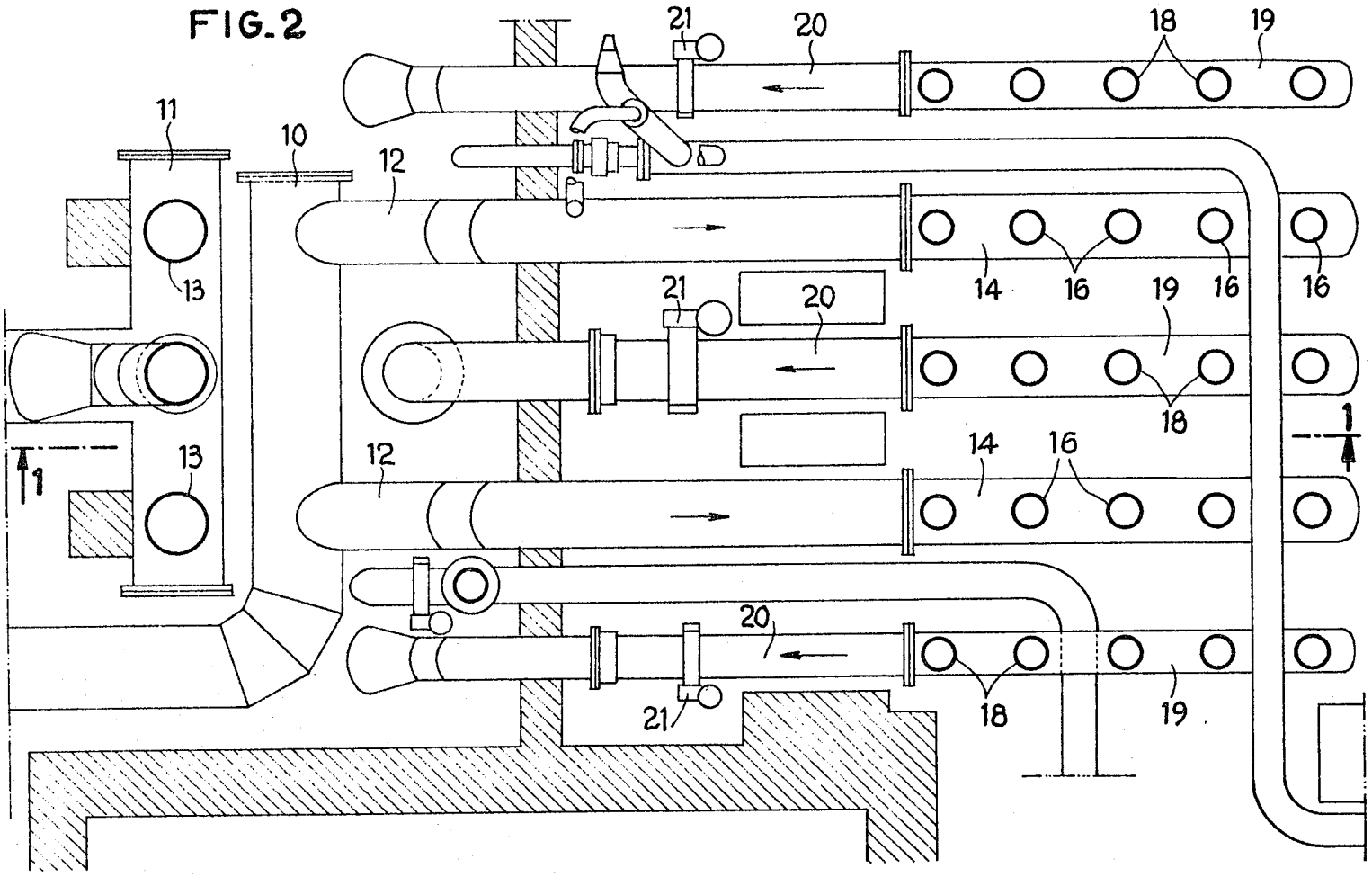
FIG. 2 is a sectional view taken on line 2—2 of FIG. 1.

The drawings show a cooling machine of the general type such as that described in French Pat. No. 73 10 710. This machine comprises in the illustrated embodiment five sets of guiding and driving rolls for the sheet, the lower rolls 1 being carried by a lower frame 2 which is fixed whereas the upper rolls 3 are carried by a movable upper frame 4 so that it is in particular possible to effect an adjustment in height and possibly place the machine in an inoperative position. The lower and upper frames define an enclosure 5 in which there circulates the cooling fluid, in the presently-described embodiment water which flows round the guiding and driving rolls.

In the illustrated embodiment, the cooling liquid is supplied and discharged by way of conduits which communicate with the enclosure in the region of the driving rolls.

The supply circuit comprises two manifolds 10, 11 disposed in the lower part of a recovery tank R from which manifolds extend pipes 12, 13 which are respectively connected to other manifolds 14, 15 parallel to the rolls, disposed above and below the upper and lower frames and connected to the enclosure through roughly vertical supply conduits 16, 17. It will be understood that suitable pumping means are provided for supplying the cooling liquid but have not been shown in the drawings.

As the cooling liquid is supplied in the region of even sets of rolls, it is discharged in the region of odd sets of rolls disposed at the two ends of the machine and in the centre part of the latter. These means comprise conduits 18 which extend downwardly from the lower frame and are connected to manifolds 19 which are parallel to the rolls and are connected by a separate pipe 20 to the recovery tank. Valves 21 are placed in these pipes for regulating the discharge flow from the lower part of the machine and consequently the pressure drop in the machine.

Figure 3:
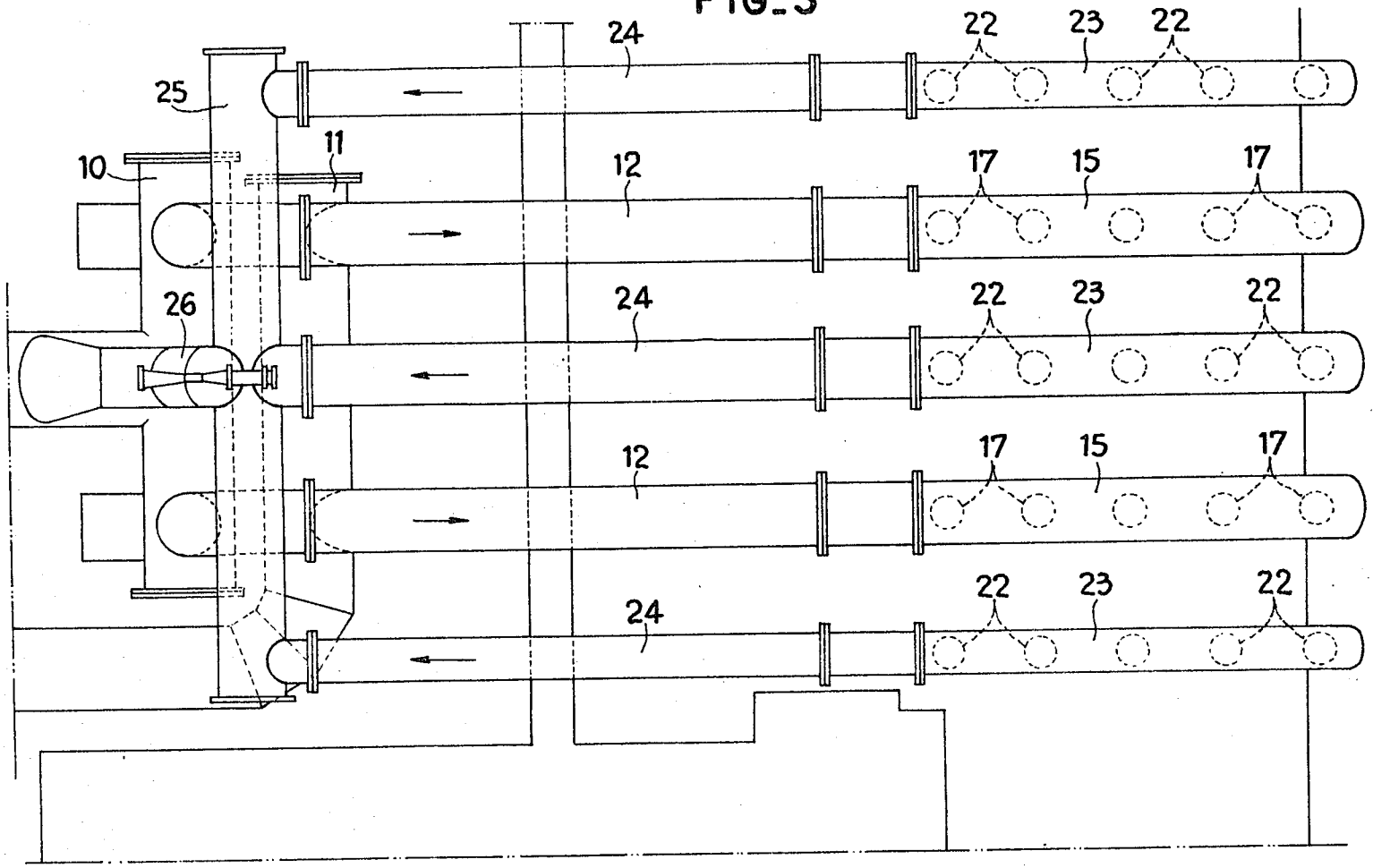
FIG. 3 is a diagrammatic plan view in the direction of arrow 3 shown in FIG. 1.

The upper discharge means comprise also conduits 22 which are disposed roughly vertically and are connected to horizontal manifolds 23 which are parallel to the driving and guiding rolls. As can be seen in FIGS. 1 and 3, these manifolds are connected by flexible pipes 24 to a common manifold 25 which is parallel to the longitudinal direction of the machine. This manifold is connected by a pipe 26 to the recovery tank. The whole of the upper discharge device consequently constitutes a siphon and there is provided on the common manifold 25 a priming device, here formed by an ejector 27 which is connected to a source of air under pressure. It will be understood that other like means may be employed for performing this priming function.

The installation just described operates in the following manner:

The valves 21 placed on the lower discharge conduits 20 enable the pressure drop in the machine to be increased and regulated so that the cooling liquid tends to mount in the upper discharge conduits. The ejector 27 placed on the manifold 25 primes the siphon which constitutes the upper discharge device and, when the siphon has been primed, the pressure or the depression at the ends of the machine in the region of the plane of the sheet passage line, is equal to $p=h-\omega$, in which h represents the height of the passage line above the water surface of the recovery tank and $\omega$ represents a function of the pressure drops in the piping, the valves and the body of the machine.

Thus it can be seen that, owing to the presence of the siphon and the valves placed on the lower discharge conduits, the pressure p can be brought to a low and positive value at the ends of the machine so that leakages in this region may be very substantially reduced.

The valves 21 also permit an adaptation in accordance with the width of the sheet by a compensation of the variation of the pressure drop which results from the passage of sheets of different widths.

Further, the means employed are particularly simple to use and they are not very expensive.

Note also that flexible pipes are provided in the upper supply and discharge devices so as to adjust and move in height the upper frame so as to avoid hindering the normal operation of the machine.

Having now described our invention what we claim as new and desire to secure by Letters Patent is:

1. A machine for cooling sheets comprising a lower frame and an upper frame, sets of sheet driving and guiding rolls rotatively mounted in said frames, said frames defining an enclosure which surrounds said rolls and in which enclosure a cooling fluid circulates, a system of fluid discharge conduits connected to the upper frames and a system of fluid discharge conduits connected to the lower frame, the systems having discharge conduits disposed in the vicinity of input and output ends of the machine, a cooling fluid recovery tank, at least the discharge conduits connected to the upper frame and located in the vicinity of the input and output ends of the machine being connected to the cooling fluid recovery tank with interposition of a siphon, a priming device combined with said siphon for creating a depression in said siphon.

2. A machine as claimed in claim 1, comprising means for regulating the pressure drop in the machine and associated with the cooling fluid discharge system of the lower frame.

3. A machine as claimed in claim 1, comprising on at least one discharge conduit connected to the lower frame a valve adapted to regulate the flow in said at least one conduit.

* * * * *